United States Patent [19]

Watzke

[11] 4,390,762

[45] Jun. 28, 1983

[54] CONTACT PIECE FOR AN ELECTRIC VACUUM SWITCH

[75] Inventor: Franz Watzke, Berlin, Fed. Rep. of Germany

[73] Assignee: Siemens Aktiengesellschaft, Berlin and Munich, Fed. Rep. of Germany

[21] Appl. No.: 240,157

[22] Filed: Mar. 3, 1981

[30] Foreign Application Priority Data

Mar. 14, 1980 [DE] Fed. Rep. of Germany ..... 3009925

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,327,081 | 6/1967 | Pflanz | 200/144 B |
| 3,711,665 | 1/1973 | Dethlefsen | 200/144 B |
| 4,149,050 | 4/1979 | Gorman et al. | 200/144 B |

FOREIGN PATENT DOCUMENTS

| | | | |
|---|---|---|---|
| 47-4384 | 7/1972 | Japan | 200/144 B |
| 1143829 | 2/1969 | United Kingdom | 200/144 B |
| 1145151 | 3/1969 | United Kingdom | 200/144 B |
| 1210600 | 10/1970 | United Kingdom | 200/144 B |

*Primary Examiner*—Robert S. Macon

*Attorney, Agent, or Firm*—Herbert L. Lerner; Laurence A. Greenberg

[57] ABSTRACT

Contact piece for an electric vacuum switch, including a contact carrier base, an obliquely slotted contact carrier wall having an upper surface and being integral with the base forming a pot-shaped contact carrier together with the bsae, the pot-shaped contact carrier being substantially formed of copper and having a circular cross-section, an unslotted substantially planar contact ring being formed of a contact material and being disposed in the upper surface of the wall, the wall having a circular groove with a rectangular cross-section formed therein extended downwardly from the upper surface thereof, and another unslotted ring formed of a material having a greater resistance than copper being disposed in the groove.

5 Claims, 2 Drawing Figures

CONTACT PIECE FOR AN ELECTRIC VACUUM SWITCH

Figure 1:
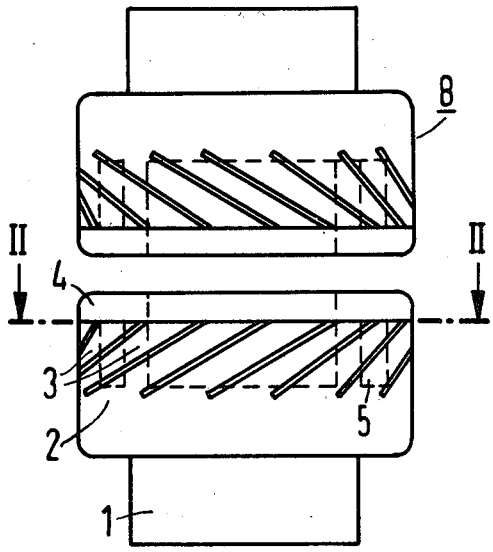

The invention relates to a contact piece for an electric vacuum switch which has the following characteristics:

(a) a contact base and an obliquely slotted contact carrier wall form a pot-shaped contact carrier which is substantially formed of copper and which has a circular cross-section;

(b) on the contact carrier wall there is disposed an unslotted substantially planar contact ring which is formed of a contact material.

A contact piece of this kind is known and described, for example, in German Published, Non-Prosecuted Application DE OS 28 28 182. The slotted section of the contact carrier wall which is oppositely directed in the two opposite contact pieces of a vacuum switch, effects a magnetic deflection of the arc which occurs when the contact pieces are separated. This furthermore causes the arc to rotate on the contact surface. Thus, a high quenching reliability with little burning-off is achieved.

A disadvantage of this obliquely slotted section is the decreased strength of the contact carrier. The contact pieces are partially compressed by the switching load in the course of the lifetime thereof. As a result, after approximately 300 switchings, the stroke of the vacuum switch has to be adjusted and no exactly defined burning-off marking is possible on the vacuum switch.

It is accordingly an object of the invention to provide a contact piece for an electric contact switch which overcomes the hereinaforementioned disadvantages of the heretofore-known devices of this general type, and to do so by increased mechanical strength of the contact pieces.

With the foregoing and other objects in view there is provided, in accordance with the invention, a contact piece for an electric vacuum switch, comprising a contact carrier base, an obliquely slotted contact carrier wall having an upper surface and being integral with the base forming a pot-shaped contact carrier together with the base, the pot-shaped contact carrier being substantially formed of copper and having a circular cross-section, an unslotted substantially planar contact ring being formed of a contact material and being disposed in the upper surface of the wall, the wall having a circular groove with a rectangular cross-section formed therein extended downwardly from the upper surface thereof, and another unslotted ring formed of a material having a greater resistance than copper being disposed in the groove.

In accordance with another feature of the invention, the groove is radially formed substantially in the center of the wall and has a width being substantially one third of the thickness of the wall.

In accordance with an added feature of the invention, the groove has a depth equal to the height of the wall.

In accordance with an additional feature of the invention, the other ring is formed of high-grade steel which is suitable as material which has a higher resistance than copper.

In accordance with a concomitant feature of the invention, the high-grade steel other ring is formed of an alloy including chromium, nickel and titanium.

A ring of this kind which is inserted into the groove of the slotted contact carrier wall gives it an adequate strength relative to the switching operations. Since the electric conductivity is lower than in the case of copper—in the case of high-grade steel only 2 to 3% of that of copper—the electrical effect of the slotted section is not eliminated by a short-circuit. The unslotted ring increases the strength without impairing the arc rotation.

Other features which are considered as characteristic for the invention are set forth in the appended claims.

Although the invention is illustrated and described herein as embodied in a contact piece for an electric vacuum switch, it is nevertheless not intended to be limited to the details shown, since various modifications and structural changes may be made therein without departing from the spirit of the invention and within the scope and range of equivalents of the claims.

Figure 2:
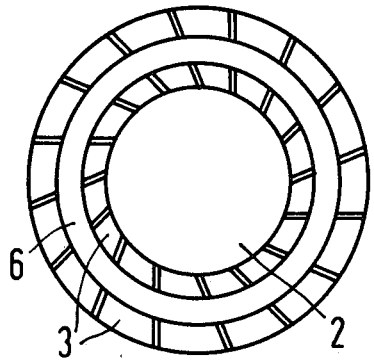

The construction and method of operation of the invention, however, together with additional objects and advantages thereof will be best understood from the following description of specific embodiments when read in connection with the accompanying drawings, in which:

FIG. 1 is a diagrammatic side-elevational view of the contact piece of the invention; and FIG. 2 is a cross-sectional view of FIG. 1 taken along the lines II—II therein, in the direction of the arrows.

Referring now to the figures of the drawing and first, particularly to FIG. 1 thereof, it is seen that reference numeral 1 designates a contact stud in a vacuum switch, on the end of which a pot-shaped contact piece is located. This contact piece includes a contact carrier base 2 which is formed of an overlying obliquely slotted contact carrier wall 3 and an overlying unslotted contact ring 4. As can be gathered from the cross-section which appears as a plan view in FIG. 2, the slots are rotated approximately through an angle of 30° relative to the radii. The slots are inclined by an angle of 50° in relation to the contact piece axis and a quantity of 16 are evenly distributed over the periphery. Depending upon the type of production used, the slots can extend somewhat into the contact carrier base 2. The contact stud 1, the contact carrier base 2 and the contact carrier wall 3 are essentially formed of copper.

As a result of a coaxial groove 5 being formed in the contact carrier wall 3 and having the same axial length as the contact carrier wall 3, the wall 3 is divided into two coaxial slotted rings, these rings and the groove 5 having approximately the same radial dimension. The groove 5 is filled with an unslotted high-grade steel ring 6 having a rectangular cross-section. The unslotted plane contact ring 4 having the same circular cross-section is soldered onto the contact carrier wall 3. The contact ring 4 is formed of a chromium matrix which is saturated with copper.

A contact piece 8 having the same construction as the first-mentioned contact piece, except for the inclination of the slots, is axially disposed opposite to this first-mentioned contact piece. The slots are symmetrically inclined with respect to those of the contact carrier wall 3, in relation to an axial section.

It can further be seen from the view which is illustrated in FIG. 2, which shows the contact piece in accordance with FIG. 1 with the contact ring removed, how by means of the closed high-grade steel ring 6 the slotted contact carrier wall 3 is divided into a double wall which is constructed of slotted partial walls of approximately equal thickness, which have a thickness of approximately one third of the overall wall thickness.

There are claimed:

1. Contact piece for an electric vacuum switch, comprising a contact carrier base, an obliquely slotted contact carrier wall having an upper surface and being integral with said base forming a pot-shaped contact carrier together with said base, said pot-shaped contact carrier being substantially formed of copper and having a circular cross-section, an unslotted substantially planar contact ring being formed of a contact material and being disposed in said upper surface of said wall, said wall having a circular groove with a rectangular cross-section formed therein extended downwardly from said upper surface thereof, and another unslotted ring formed of a material having a greater resistance than copper being disposed in said groove.

2. Contact piece according to claim 1, wherein said groove is radially formed substantially in the center of said wall and has a width being substantially one third of the thickness of said wall.

3. Contact piece according to claim 1 or 2, wherein said groove has a depth equal to the height of said wall.

4. Contact piece according to claim 1 or 2, wherein said other ring is formed of high-grade steel.

5. Contact piece according to claim 4, wherein said high-grade steel other ring is formed of an alloy including chromium, nickel and titanium.

* * * * *